US005655205A

United States Patent [19]

Ziegelmuller et al.

[11] Patent Number: 5,655,205

[45] Date of Patent: Aug. 5, 1997

[54] MECHANISM FOR CLEANING THE BACK SIDE OF A WEB IN AN ELECTROSTATOGRAPHIC REPRODUCTION APPARATUS

[75] Inventors: Francisco Luiz Ziegelmuller; Donald C. Buch, both of Penfield, N.Y.

[73] Assignee: Eastman Kodak Company, Rochester, N.Y.

[21] Appl. No.: 487,265

[22] Filed: Jun. 7, 1995

[51] Int. Cl.[6] ..... G03G 21/00

[52] U.S. Cl. ..... 399/350; 399/98; 399/162; 399/356

[58] Field of Search ..... 355/296, 299, 355/305, 212; 15/1.51, 100, 256.5, 256.51; 399/71, 98, 349, 350, 351, 360, 356, 358, 162, 164

[56] References Cited

U.S. PATENT DOCUMENTS

| | | | |
|---|---|---|---|
| 3,641,605 | 2/1972 | Lindsay | 355/296 X |
| 3,692,404 | 9/1972 | Lester et al. | 355/212 |
| 4,571,070 | 2/1986 | Tomita | 355/305 |
| 4,630,920 | 12/1986 | Silverberg et al. | 399/350 X |
| 4,827,311 | 5/1989 | Bothner et al. | 355/297 |
| 4,853,741 | 8/1989 | Ku | 355/300 |
| 4,903,083 | 2/1990 | Bothner | 355/300 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,021,834 | 6/1991 | Tsuruoka et al. | 399/350 X |
| 5,025,291 | 6/1991 | Nowak et al. | 355/273 |
| 5,043,760 | 8/1991 | MacLellan et al. | 355/296 |
| 5,282,005 | 1/1994 | Nowak et al. | 355/273 |
| 5,506,669 | 4/1996 | Inoue et al. | 355/296 |
| 5,519,480 | 5/1996 | Thayer et al. | 355/296 X |

*Primary Examiner*—S. Lee
*Attorney, Agent, or Firm*—Lawrence P. Kessler

[57] ABSTRACT

A mechanism for cleaning the back side of an image bearing dielectric support web used in an electrostatographic reproduction apparatus, the dielectric support web, having a front side movable into operative association with a plurality of electrographic processing stations to form a transferable marking particle image thereon. The back side cleaning mechanism have a catch tray for collecting debris removed from the back side of the dielectric support web. A cleaning blade is attached to the catch tray so as to engage the back side of the dielectric support web at a predetermined angle to wipe such back side thereof. A magnetic scavenger is attached to the catch tray, in spaced relation with the cleaning blade, so as to remove magnetic particles from the back side of the dielectric support web.

28 Claims, 3 Drawing Sheets

MECHANISM FOR CLEANING THE BACK SIDE OF A WEB IN AN ELECTROSTATOGRAPHIC REPRODUCTION APPARATUS

BACKGROUND OF THE INVENTION

The present invention relates in general to the cleaning of webs in reproduction apparatus, and more particularly to a mechanism for cleaning the back side of a dielectric web in an electrostatographic reproduction apparatus.

In typical commercial reproduction apparatus (for example, electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member and the image is fixed to the receiver member by heat and/or pressure to form a permanent reproduction thereon.

One type of dielectric member typically utilized in the electrostatographic reproduction apparatus is a composite web having a base of flexible material. The web is entrained about a plurality of support rollers so as to form a closed loop path. The web is driven about the closed loop path to present particular areas of the web sequentially into association with electrographic process stations to form desired reproductions. It is common for airborne debris, such as marking particles and paper dust for example, to be attracted to, and collect on, the back side of the web. While this may not be of major consequence for dielectric support webs where the latent image charge patterns are formed from the front side of the web, it can cause undesirable image defects in the produced reproductions if the latent image charge patterns are formed from the back side of the web. Moreover, debris on the back side of the dielectric web may adversely effect performance of the web as it is driven about the closed loop path and, ultimately, overall performance of the reproduction apparatus.

Several mechanisms have been generally successfully employed for cleaning the back side of the dielectric support web of electrostatographic reproduction apparatus. One mechanism includes a stationary pad of a material, such as cotton for example. This pad can easily become saturated with debris; and, the period of time during which it takes for the pad to become saturated is not readily predictable. Saturation of the pad can cause excessive abrasion and scratching of the web. Therefore, the pad must be frequently inspected and cleaned.

Another mechanism for cleaning the back side of the dielectric web is shown in U.S. Pat. No. 4,853,741 (issued Aug. 1, 1989, in the name of Ku). The cleaning mechanism of the '741 patent utilizes an indexing web of material, such as a fabric of a nonwoven blend of polyester and rayon for example. The web is periodically indexed by a motor coupled to the mechanism. While this mechanism reduces the necessity for frequent inspection, as required with the stationary pad described above, it is of a more complex and expensive construction, requires a relatively more sophisticated control device, and takes up more space in the reproduction apparatus. It may also scratch the dielectric support web if it picks up any abrasive particles or debris.

SUMMARY OF THE INVENTION

In view of the foregoing discussion, this invention is directed to a mechanism for cleaning the back side of an image bearing dielectric support web used in an electrostatographic reproduction apparatus, the dielectric support web, having a front side movable into operative association with a plurality of electrographic processing stations to form a transferable marking particle image thereon. The back side cleaning mechanism comprises a catch tray for collecting debris removed from the back side of the dielectric support web. A cleaning blade is attached to the catch tray so as to engage the back side of the dielectric support web at a predetermined angle to wipe such back side thereof. A magnetic scavenger is attached to the catch tray, in spaced relation with the cleaning blade, so as to remove magnetic particles from the back side of the dielectric support web.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
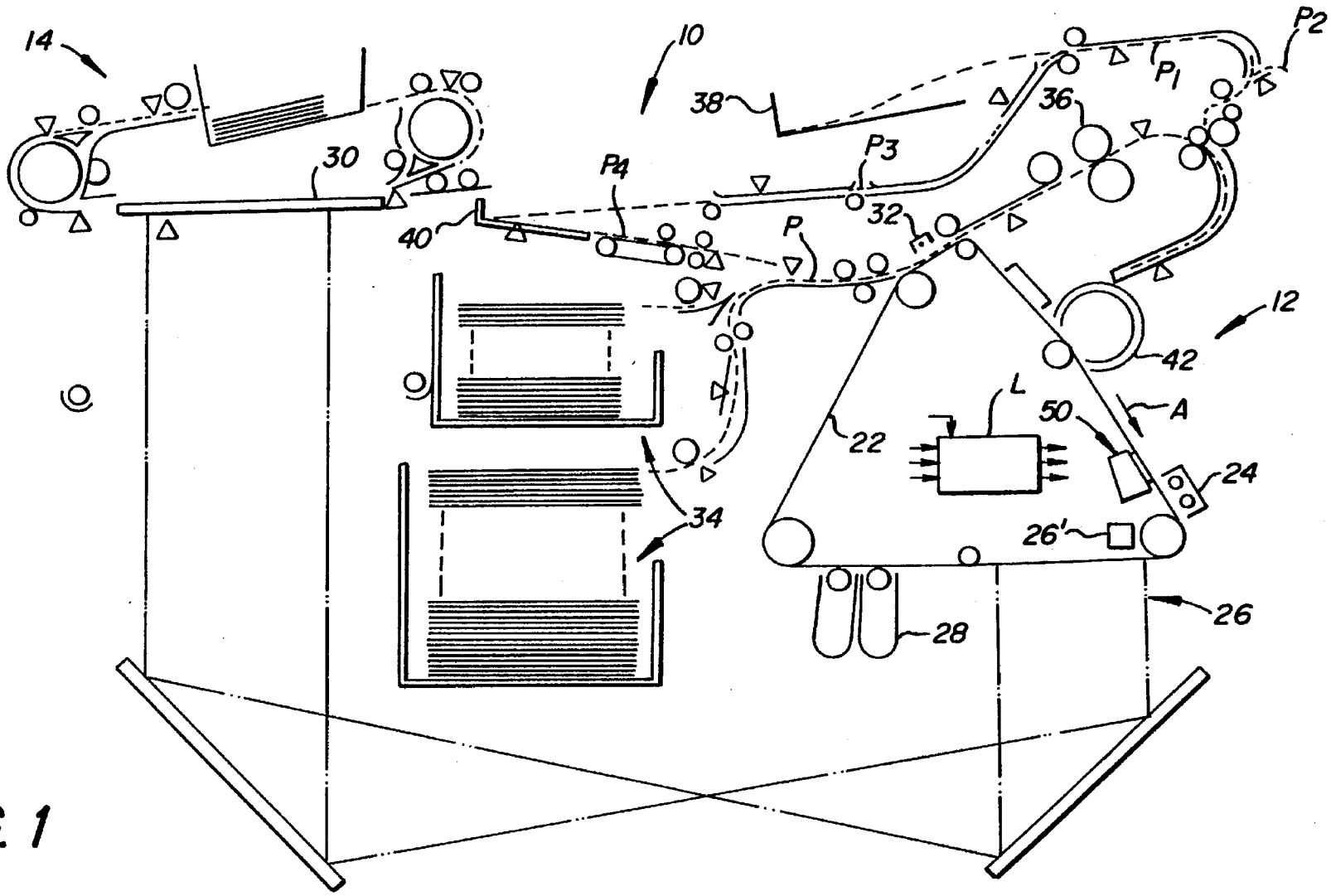
FIG. 1 is a schematic side elevational view of an electrostatographic reproduction apparatus including a dielectric support web and utilizing a back side cleaning mechanism for such support web, according to this invention, with portions of the reproduction apparatus removed to facilitate viewing.

Referring now to the accompanying drawings, FIG. 1 schematically shows a typical electrostatographic reproduction apparatus, designated generally by the numeral 10. The reproduction apparatus 10 has a marking engine 12 for producing copies of original information, such as original documents circulated by a document feeder 14. Several well known finishing accessories, such as sorters and stacker/staplers (not shown), may be associated with marking engine 12. Of course, other well known marking engines and associated accessories, serving in various configurations as copiers or printers, are suitable for use with this invention.

The basic arrangement and operation of the exemplary marking engine 12 (and associated accessories) for the reproduction apparatus 10 is described herein in sufficient detail for a complete understanding of this invention. The marking engine 12 has a dielectric support 22 in the form of a web mounted, for example, on tracking rollers for movement about an endless path in the direction indicated by the arrow A. In the reproduction cycle, the moving dielectric support web 22 is uniformly charged as it moves past a primary charging station 24. Thereafter, the uniformly charged dielectric support passes through an exposure station 26 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support web 22 to a reflected light image of an original document to be reproduced. For example, the original document may be delivered to a transparent platen 30 by the document feeder 14. Alternatively, formation of the latent image charge pattern may be accomplished by "writing" directly on the dielectric support web with a light assembly 26' (e.g., a plurality of independently activated LED's or a laser) or point electrodes activated by electronically generated signals based on the desired information to be reproduced. In the illustrated embodiment, the light assembly 26' is located within the closed loop path of the dielectric support web 22, and exposes the web through the back side thereof.

The latent image charge pattern, as formed on the dielectric support web 22, is then brought into association with a development station 28 which applies electroscopically charged pigmented marking particles to adhere to the dielectric support to develop the latent image. The portion of the dielectric support web 22 carrying the developed image then passes through a transfer station 32 in register with a receiver member, fed in proper timed relation from a supply hopper 34, along the path P. The transfer station 32 includes, for example, a DC corona charger coupled to an electrical potential source (not shown) to provide an electric field which attracts the marking particles of the developed image from the dielectric support web to the receiver member. Of course, other transfer mechanisms, such as an electrically biased roller for example, are suitable for use with this marking engine 12. After the marking particles of the developed image have been transferred to the receiver member and the receiver member is separated from the dielectric support web, the receiver member is transported through a fusing device 36 where the image is fixed to the receiver member by heat and/or pressure, for example.

The receiver member bearing the fixed image is then selectively delivered to an appropriate desired output. Simultaneously, with delivery of the receiver member to the desired output, the dielectric support web 22 is cleaned of any residual marking particles at cleaning station 42 and returned to the primary charging station 24 for reuse. During delivery of the receiver member, the receiver member may be directed along path $P_1$ to a top exit hopper 38 for direct operator retrieval, or along path $P_2$ through a side exit for delivery to one of the output accessories. Alternatively, the output may be directed from path $P_1$ along the path $P_3$ to an intermediate hopper 40. In the path $P_3$, the receiver member is effectively turned over, and thereafter delivered along the path $P_4$ to return to the path P and the transfer station 32 to enable a duplex reproduction to be formed on such receiver member.

The set up and operation of the reproduction apparatus 10 is controlled by a logic and control unit L located, for example, within the housing of the reproduction apparatus 10. The logic and control unit L includes a microprocessor based controller electrically coupled to the marking engine and accessories of the reproduction apparatus 10. The controller includes random access memory (RAM), read only memory (ROM), and non-volatile memory. The controller may also include a reader/writer to non-volatile media, such as a disk.

In order to control the operation of the reproduction apparatus 10, the controller of the logic and control unit L receives input signals from an operator control interface (not shown) and a plurality of sensors associated in any well known manner with the reproduction apparatus marking engine 12 and accessories. Based on such signals and a program for the microprocessor, the logic and control unit produces appropriate signals to control the various operating devices within the reproduction apparatus. The production of a program for a number of commercially available microprocessors is a conventional skill well understood in the art and does not form a part of this invention. The particular details of any such program would, of course, depend upon the architecture of the designated microprocessor.

As discussed above, in order to prevent undesirable image defects in the produced reproductions, it is often necessary to remove airborne debris, such as marking particles and paper dust for example, which are attracted to, and collect on, the back side of the dielectric support web of the reproduction apparatus. Moreover, debris on the back side of the dielectric support web may adversely effect performance of the support web as it is driven about the closed loop path and, ultimately, adversely effect overall performance of the reproduction apparatus. Thus, in accordance with this invention, a mechanism designated generally by the numeral 50 is provided for cleaning the back side of the dielectric support web 22.

Figure 2:
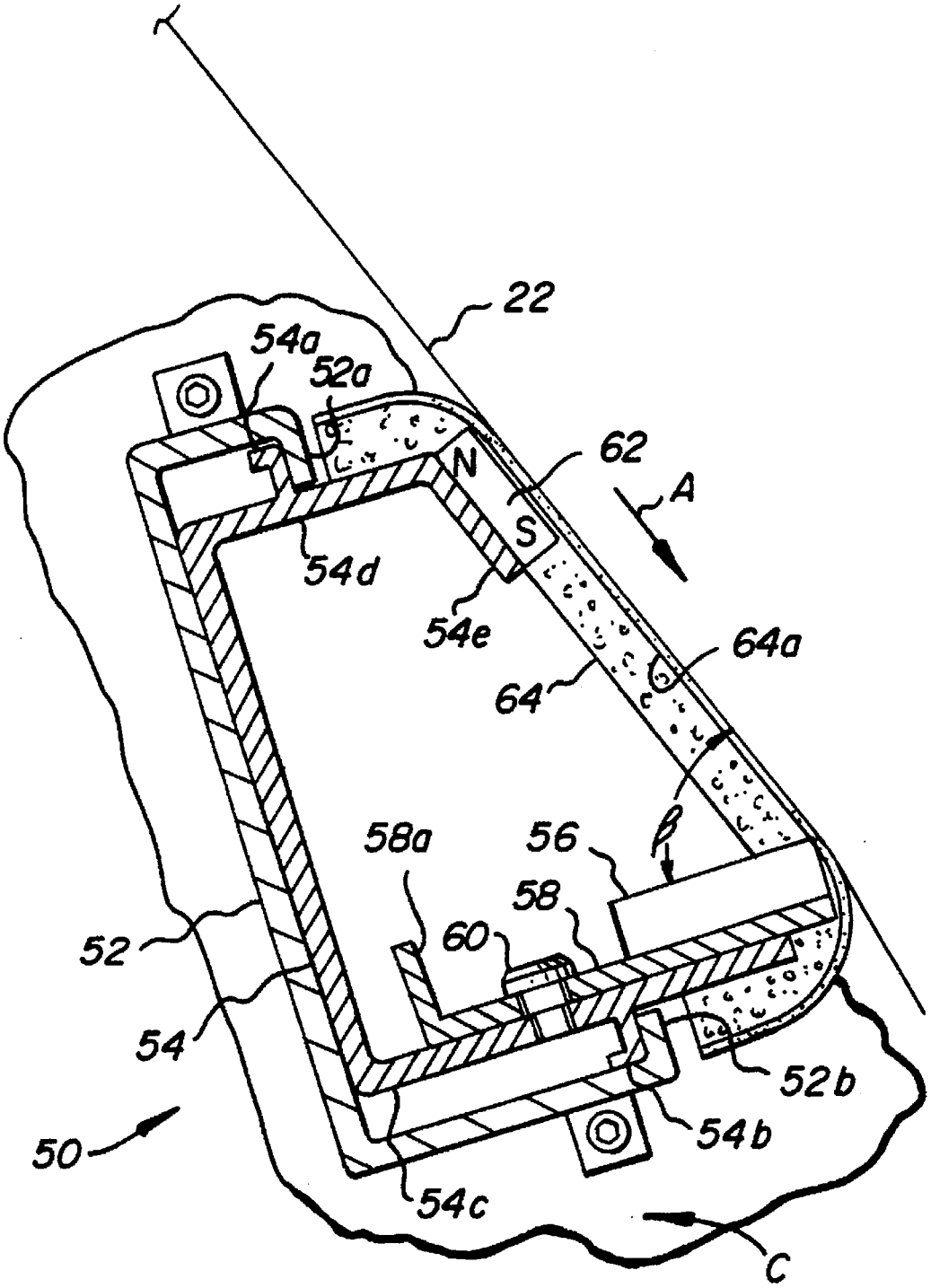
FIG. 2 is a side elevational view of a portion of the dielectric support web and the back side cleaning mechanism, in cross-section and on an enlarged scale, with portions broken away or removed to facilitate viewing.
Figure 3:
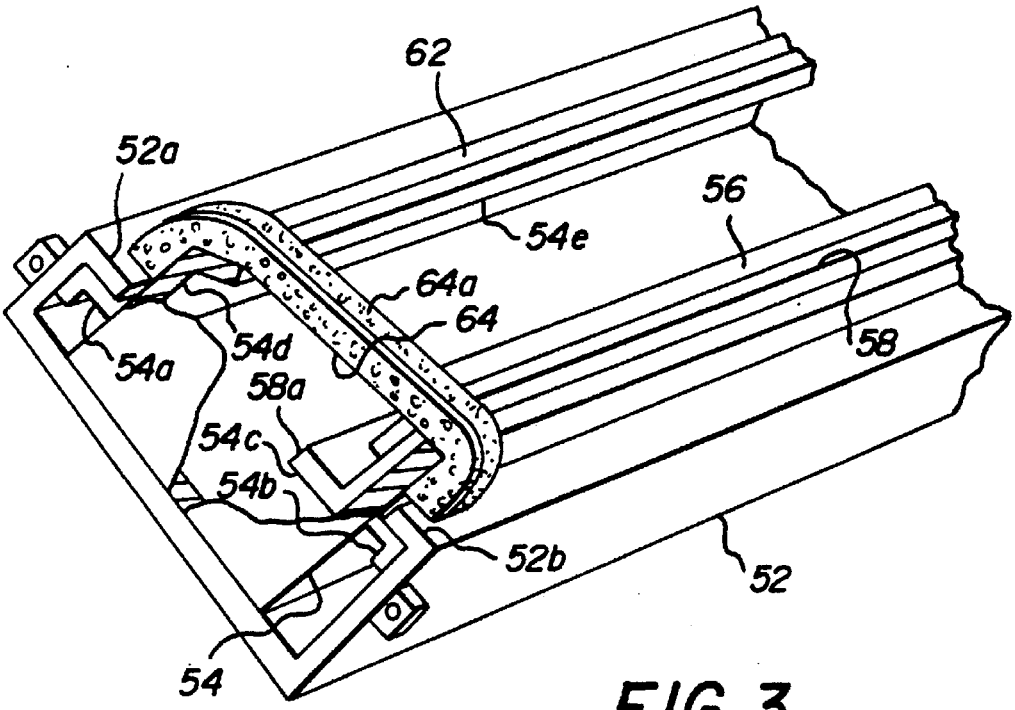
FIG. 3 is a view, in perspective, of a portion of the back side cleaning mechanism, according to this invention, as shown in FIG. 2, with portions broken away or removed to facilitate viewing.

The back side cleaning mechanism 50, as best shown in FIGS. 2 and 3, includes a support member 52 attached to the core C for the dielectric support web 22. The support member 52 is located within the closed loop path of the dielectric web substantially downstream (in the direction of travel of the dielectric support web) of the front side cleaning mechanism 42 and upstream of the primary charger 24. Such location assures that the back side cleaning action takes place after front side cleaning of the dielectric support web 22 and before marking particle image development of a latent image on the web. This serves to substantially prevent trapping of any unremoved magnetic carrier particles on the front side of the dielectric support web (which might scratch or otherwise damage the web), or any possible disruption of a developed image on the dielectric support web.

A catch tray 54, for collecting marking particles and other debris cleaned from the back side of the web, is slidably received in the support member 52. The catch tray 54 is of a substantially "C"-shaped configuration, in cross section, and has extension elements **54*a*, 54*b* which cooperate respectively with lips 52*a*, 52*b* of the support member 52 to retain and accurately locate the catch tray 54 relative to the back side of the dielectric support web 22**.

Figure 4:
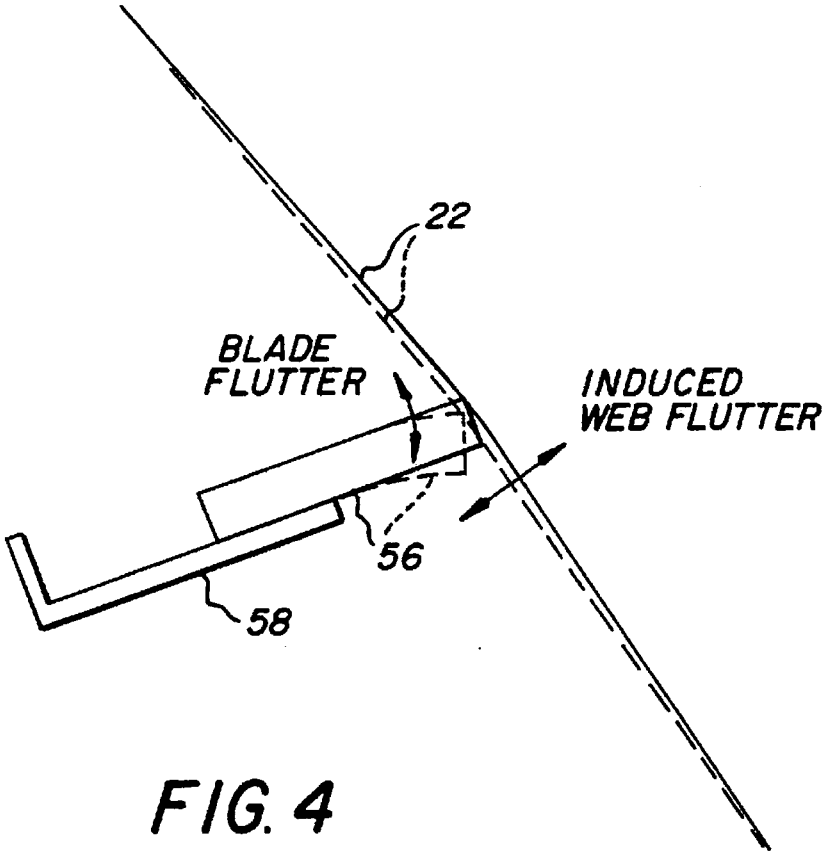
FIG. 4 is a side elevational view of a portion of the dielectric support web showing the effect of blade stiffness on web flutter.

A blade member 56 is connected to one leg **54*c* of the catch tray 54. The blade member 56 is located so as to be oriented to contact the dielectric support web 22 to provide an included angle β between the blade and the web in the range of between 60°–80°. The blade member is comprised, for example, of a slab of polyurethane having a thickness in the range of about 0.100" to 0.200" with a hardness of between 50–80 Shore A and a rebound resiliency above 30%. The combination of material characteristics and arrangement parameters is intended to provide a relatively stiff blade which wipes, rather than scrapes, the back side surface of the dielectric support web 22. The wiping action and the blade stiffness assure that a minimum transient effect will be introduced in dielectric support web movement about the closed loop path, while maximizing cleaning efficiency. That is, minimizing flutter of the cleaning blade will minimize flutter of the web. The effect of flutter of the web (which is diagramatically shown in the drawing of FIG. 4) is thus substantially prevented. The particles and debris cleaned (wiped) from the back side of the dielectric support web are collected within the catch tray 54**.

In the preferred embodiment particularly shown in FIGS. 2 and 3, the blade member 56 is connected to a stiffener plate 58 which is, in turn, adjustably attached to the leg 54*c* of the catch tray 54 by a suitable fastener 60. The stiffener plate 58 is formed of non-magnetic stainless steel, having a thickness in the range of about 0.050"–0.080", and has a bent over portion 58*a*, in the range of between 90° and 120°, along the edge of the stiffener plate opposite to the blade. The bent over portion 58*a* serves to maintain a high degree of flatness in the stiffener plate 58 (and thus the blade 56) along its length. The blade 56 extends beyond the stiffener plate 58 in the range of approximately 0.000" to 0.200". This yields the maximum flatness and stiffness for effecting cleaning without introducing any undesirable perturbations (flutter) in the movement of the dielectric support web 22 as discussed above.

Further, the catch tray 54 has an angled lip portion 54*e* extending from the leg 54*d* thereof. The angle of the lip portion 54*e* is predetermined such that, when the catch tray is located in the support member 52 of the back side cleaning mechanism 50, the surface of the lip portion is oriented to lie in a plane substantially parallel to the plane of the dielectric support web 22. An elongated magnetic bar 62 is attached to the surface of the lip portion 54*e*. The magnetic bar has a magnetic strength in the range of approximately 800–1000 Gauss, and is spaced in the range of about 0.010"–0.030" from the plane of the dielectric support web. The magnetic bar will thus serve to remove (also referred to as "scavenging") any magnetic carrier particles (part of the developer material mixture used in the development of latent electrostatic images on the dielectric support web) which adhere to the back side of the dielectric support web.

Of course other arrangements for removing magnetic carrier particles may be suitable for use with this invention. However, any alternative arrangement should be part of the overall back side cleaning mechanism 50 so that it can easily be removed with the cleaning mechanism for cleaning thereof. In an alternative example of an arrangement for removing magnetic carrier particles, the magnetic bar could be replaced by a magnetic roller friction driven by the dielectric support web. Such arrangement may be more efficient in removing carrier particles, but due to its complexity and cost may not be economically justified.

Each of the ends of the catch tray 54, between the legs 54*c* and 54*d*, are sealed by members 64 (only one end shown). The sealing members 64 are formed of a substantially foam-like material having a Teflon™ or felt cover 64*a* on the surface facing the dielectric support web 22. The sealing members 64 assure retention of the cleaned debris within the catch tray 54. The cover 64*a* for the sealing members 64 substantially prevent marking or damage to the dielectric support web by the sealing members.

The invention has been described in detail with particular reference to preferred embodiments thereof, but it will be understood that variations and modifications can be effected within the spirit and scope of the invention as set forth in the claims.

What is claimed is:

1. In an electrostatographic reproduction apparatus including an image bearing member, in the form of an endless dielectric support web, having a front side movable in a given direction into operative association with a plurality of electrographic processing stations to form a transferable marking particle image thereon, and a back side, a mechanism for cleaning the back side of such dielectric support web, said back side cleaning mechanism comprising:

means for collecting debris removed from the back side of said dielectric support web;

a cleaning blade attached to said collecting means so as to engage the back side of said dielectric support web at a predetermined angle to wipe such back side thereof; and a magnetic scavenger attached to said collecting means, in spaced relation with said cleaning blade, so as to remove magnetic particles from the back side of said dielectric support web.

2. The dielectric support web back side cleaning mechanism according to claim 1 wherein said collecting means includes a catch tray of substantially "C"-shaped cross section located adjacent to the back side of said dielectric support web.

3. The dielectric support web back side cleaning mechanism according to claim 2 wherein said magnetic scavenger is attached to one leg of said "C"-shaped catch tray.

4. The dielectric support web back side cleaning mechanism according to claim 2 wherein said cleaning blade is attached to one leg of said "C"-shaped catch tray.

5. The dielectric support web back side cleaning mechanism according to claim 4 wherein said catch tray includes an adjustable stiffener plate connected to said one leg thereof, said cleaning blade being supported by said stiffener plate in engagement with the back side of said dielectric support web.

6. The dielectric support web back side cleaning mechanism according to claim 5 wherein said cleaning blade extends beyond said stiffener plate a distance having a range, said range being approximately 0.000" to 0.200".

7. The dielectric support web back side cleaning mechanism according to claim 6 wherein said stiffener plate has a bent over portion having a range, said range being about 90° to 120°, to maintain flatness of said plate.

8. The dielectric support web back side cleaning mechanism according to claim 4 wherein said magnetic scavenger is attached to a second leg of said "C"-shaped catch tray substantially opposite said one leg to which said cleaning blade is attached, said second leg being located upstream, in said direction of movement of said dielectric support web, of said one leg.

9. The dielectric support web back side cleaning mechanism according to claim 8 wherein said second leg of said "C"-shaped catch tray includes a bent over lip portion, and said magnetic scavenger includes a bar magnet attached to said bent over lip portion.

10. The dielectric support web back side cleaning mechanism according to claim 9 wherein said bent over lip portion is oriented at a predetermined angle to locate said bar magnet in a plane spaced from, and parallel to, said dielectric support web.

11. The dielectric support web back side cleaning mechanism according to claim 10 wherein said bar magnet has a magnetic strength having a range, said range being about 800–1000 Gauss, and wherein said bent over lip portion locates said bar magnet at a distance having a range, said range being approximately 0.010"–0.030" from said dielectric support web.

12. The dielectric support web back side cleaning mechanism according to claim 2 wherein said collecting means further includes a support member slidably receiving said catch tray and retaining said catch tray in proper orientation with respect to said dielectric support web.

13. The dielectric support web back side cleaning mechanism according to claim 12 wherein said collecting means further includes means for sealing opposing ends of said C-shaped catch tray to substantially prevent escape of collected debris therefrom.

14. The dielectric support web back side cleaning mechanism according to claim 1 wherein said cleaning blade is formed of a material which causes said cleaning blade to be substantially stiff.

15. The dielectric support web back side cleaning mechanism according to claim 14 wherein said material of said cleaning blade is polyurethane of a hardness having a range, said range being about 50–80 Shore A, and a rebound resiliency above 30%.

16. The dielectric support web back side cleaning mechanism according to claim 15 wherein said cleaning blade is held relative to said dielectric support web so as to form an included angle having a range, said range being about 60°–80°.

17. For use with an electrostatographic reproduction apparatus including a member in the form of an endless dielectric support web traveling in a given direction, for bearing a marking particle image, said dielectric support web having a front side movable, upon web travel, into operative association with a plurality of electrographic processing stations to form a transferable marking particle image thereon, said electrographic processing stations including in order a primary charger, an exposure station, a development station, a transfer station, and a front side cleaning station; a mechanism for cleaning the back side of said dielectric support web, said back side cleaning mechanism comprising:

means, located between said front side cleaning station and said primary charger in said given direction of travel of said dielectric support web, for collecting debris removed from the back side of said dielectric support web; a cleaning blade attached to said collecting means so as to engage the back side of said dielectric support web at a predetermined angle to wipe such back side thereof; and a magnetic scavenger attached to said collecting means, in spaced relation with said cleaning blade, so as to remove magnetic particles from the back side of said dielectric support web.

18. The dielectric support web back side cleaning mechanism according to claim 17 wherein said collecting means includes a catch tray of substantially "C"-shaped cross section located adjacent to the back side of said dielectric support web.

19. The dielectric support web back side cleaning mechanism according to claim 18 wherein said catch tray includes an adjustable stiffener plate connected to one leg thereof, said cleaning blade being supported by said stiffener plate in engagement with the back side of said dielectric support web.

20. The dielectric support web back side cleaning mechanism according to claim 19 wherein said cleaning blade extends beyond said stiffener plate a distance having a range, said range being approximately 0.000" to 0.200".

21. The dielectric support web back side cleaning mechanism according to claim 20 wherein said stiffener plate has a bent over portion having a range, said range being about 90° to 120°, to maintain flatness of said plate.

22. The dielectric support web back side cleaning mechanism according to claim 19 wherein said magnetic scavenger is attached to a second leg of said "C"-shaped catch tray substantially opposite said one leg to which said cleaning blade is attached, said second leg, located upstream in said direction of movement of said dielectric support web of said one leg, including a bent over lip portion; and wherein said magnetic scavenger includes a bar magnet attached to said bent over lip portion.

23. The dielectric support web back side cleaning mechanism according to claim 22 wherein said bar magnet has a magnetic strength having a range, said range being about 800–1000 Gauss, and wherein said bent over lip portion is oriented at a predetermined angle to locate said bar magnet in a plane spaced from, and parallel to, the plane of said dielectric support web at a distance having a range, said range being approximately 0.010"–0.030" from said dielectric support web.

24. The dielectric support web back side cleaning mechanism according to claim 18 wherein said collecting means further includes a support member slidably receiving said catch tray and retaining said catch tray in proper orientation with respect to said dielectric support web.

25. The dielectric support web back side cleaning mechanism according to claim 24 wherein said collecting means further includes means for sealing opposing ends of said C-shaped catch tray to substantially prevent escape of collected debris therefrom.

26. The dielectric support web back side cleaning mechanism according to claim 17 wherein said cleaning blade is formed of a material which causes said cleaning blade to be substantially stiff.

27. The dielectric support web back side cleaning mechanism according to claim 26 wherein said material of said cleaning blade is polyurethane of a hardness having a range, said range being about 50–80 Shore A, and a rebound resiliency above 30%.

28. The dielectric support web back side cleaning mechanism according to claim 27 wherein said cleaning blade is held relative to said dielectric support web at an included angle having a range, said range being about 60°–80°.

* * * * *